United States Patent [19]

Granbom

[11] Patent Number: 4,926,982

[45] Date of Patent: May 22, 1990

[54] BRAKING DEVICE IN AN ARRANGEMENT FOR LINEAR MOVEMENT

[76] Inventor: Bo Granbom, Södergatan 5, S-736 00 Kungsör, Sweden

[21] Appl. No.: 287,850

[22] Filed: Dec. 15, 1988

[51] Int. Cl.[5] ..... F15B 15/08

[52] U.S. Cl. ..... 188/271; 92/88; 188/43; 188/67

[58] Field of Search ..... 188/67, 271, 381, 195, 188/196, 41, 42, 43, 44, 45, 40, 38; 92/88, 15, 18, 23, 27; 104/259

[56] References Cited

U.S. PATENT DOCUMENTS

| | | | |
|---|---|---|---|
| 3,163,380 | 12/1984 | Brodie | 188/42 |
| 3,871,267 | 3/1975 | Miller | 92/88 |
| 4,137,827 | 2/1979 | Hewitt | 92/88 X |
| 4,419,924 | 12/1983 | Peter et al. | 188/67 |
| 4,615,515 | 10/1986 | Suzuta et al. | 188/43 X |
| 4,785,716 | 11/1988 | Vaughn et al. | 92/88 X |
| 4,825,746 | 5/1989 | Herner | 92/88 X |

FOREIGN PATENT DOCUMENTS

| | | |
|---|---|---|
| 0104364 | 8/1983 | European Pat. Off. . |
| 2404244 | 8/1975 | Fed. Rep. of Germany . |

*Primary Examiner*—Andres Kashnikow
*Assistant Examiner*—Matthew C. Graham
*Attorney, Agent, or Firm*—Cushman, Darby & Cushman

[57] ABSTRACT

A braking device in an arrangement for linear movement comprising an elongated part and a part movable in relation thereto. Along substantially the entire stroke of the movable part of a piston there is at least one first braking surface movably arranged in relation to the central axis of the elongated cylinder, the braking surface being adapted for co-action with a second braking surface arranged in association with the piston.

8 Claims, 5 Drawing Sheets

BRAKING DEVICE IN AN ARRANGEMENT FOR LINEAR MOVEMENT

BACKGROUND OF THE INVENTION

The present invention relates to a braking device in an arrangement for linear movement, comprising an elongated part and a part that is movable in relation thereto.

In pressurized fluid cylinders, operating with compressible media, such as compressed air, there are great difficulties in braking and keeping the piston—piston rod—straight in one or more pre-determined positions along the stroke of the piston. The piston must be stopped in the intended position and kept in this position, irrespective of whether it is unloaded or loaded. One solution for stopping and fixing the piston in an intended stationary position is to provide the piston—piston rod—with an accompanying belt or chain, which is directly actuable by a braking means. However, there is in this solution great risk of wear and rupture of the belt or chain. Careful maintenance is necessary, as well as smooth braking, if the arrangement is to function properly.

Another solution is illustrated in the European Patent Publication 0104364. This relates to a braking device associated with working cylinder which has no piston rod. A fluid driven braking means is incorporated in the movable dog of the arrangement, the braking means acting against the working cylinder. This means a relatively complicated structure for the fluid driven braking means, as well as the requirement of a flexible line for the fluid supply to the braking means, which moves together with the dog.

There are also great difficulties in achieving effective braking and locking of the dog or rider in cylinders with magnetic pistons, which drive such a rider situated outside the cylinder and guided by it. There is also a corresponding situation for so-called linear motors, where a movable body is moved with the aid of electromagnets along a linear rail or the like.

SUMMARY OF THE INVENTION

The present invention intends to eliminate the problems associated with the prior art technique for braking an apparatus for linear movement, i.e. when a movable part moves linearly along an elongated part, e.g. a piston cylinder arrangement, simultaneously as the braking device can be made considerably more simply than what has so far been the case.

BRIEF DESCRIPTION OF THE DRAWINGS

The invention will now be described in more detail in the form of examples and with reference to the drawing, in which FIG. 1 schematically illustrates in partial section a piston-cylinder of a known type, in which the invention, illustrated in the following Figures, is applied, FIG. 2 schematically illustrates in perspective a first embodiment of the invention, FIG. 3 schematically illustrates in perspective a second embodiment of the invention, FIG. 4 schematically illustrates in section a third embodiment of the invention.

DETAILED DESCRIPTION

Figure 1:
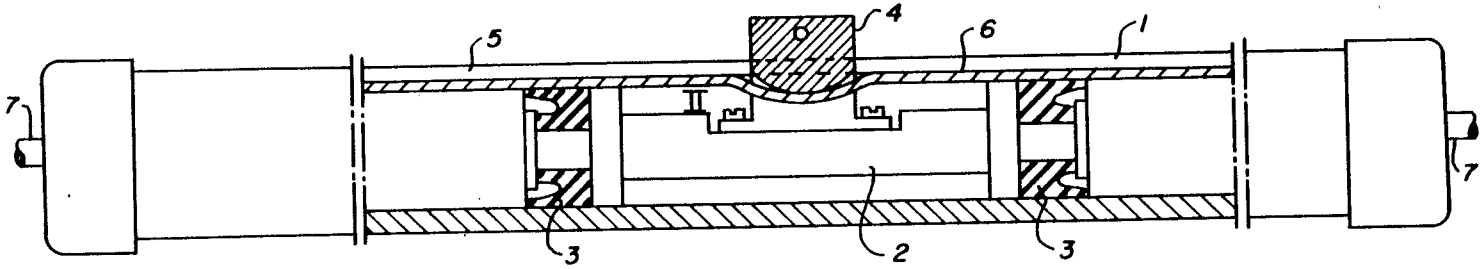
FIG. 1 (PRIOR ART)

For the purpose of more easily understanding the invention as it is shown in FIGS. 2–6, a summary explanation will now be made of a known piston-cylinder arrangement without a piston rod, together with which the invention will be described. This type of piston-cylinder arrangement principally comprises a cylinder 1 and a piston 2, the ends of the piston being provided with seals 3. The piston 2 is also provided with a propelling dog 4, extending from the piston through a longitudinal slit 5 in the cylinder wall. A sealing strip 6 seals the slit. The ends of the cylinders are sealed by end covers which are provided with compressed air connections 7.

The invention will be described hereinafter against the background of this summarily described cylinder type.

Figure 2:
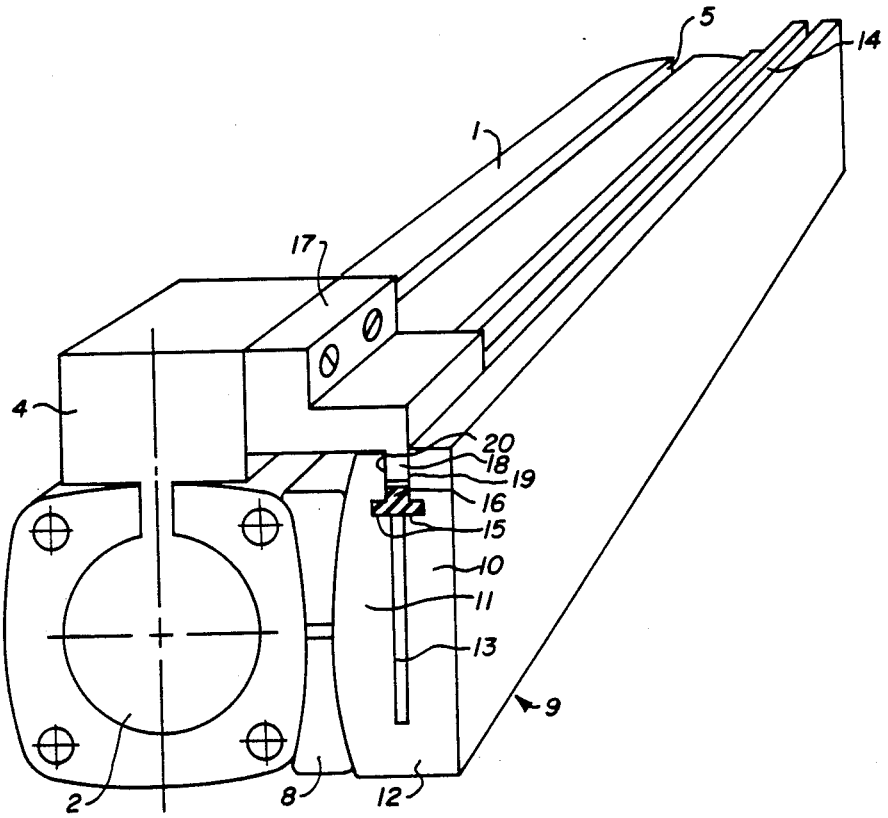

A first embodiment of the invention is illustrated in FIG. 2. The cylinder 1 is illustrated very schematically and its end covers are not drawn in. The piston 2 provided a dog 4 moves in the cylinder 1. The slit is denoted by the numeral 5. A bar section 9 extending along the entire length of the cylinder 1 is attached via an adapter member 8 to the cylinder, the adapter member also extending the entire length of the cylinder. In principle, this bar section is formed by two legs 10 and 11, mutually joined by a web 12. The space between the legs is divided into a narrow space 13 which opens out into a wider groove 14 in the vicinity of the edge portions of the legs. At a junction between the space 13 and the groove 14 each leg is provided with a groove 15 along the section 9, for accommodating a T-shaped sealing strip 16. It will be understood that as with the cylinder 1 the section 9 is internally sealed off at its ends. There is a connection (unillustrated) for joining the space 13 to a fluidized medium source. A braking device 17 is attached to the dog 4, and has a flange portion 18 extending down into the groove 14. The free edge of the flange portion 18 ends spaced from the outer surface of the sealing strip 16.

When there is a pressure in the space 13, the legs 10 and 11 are urged apart, allowing the flange portion of the braking device 17 to move unhindered in the groove 14 when the piston 3 and dog 4 move in the cylinder 1. As soon as pressure is reduced in the space 13 the leg 10 will spring back towards the leg 11, the braking surfaces 19 and 20 defining the groove 14 will clamp the flange portion 18 between them. The piston and dog are thus braked in a fixed position.

In a practical embodiment, the movement in the cylinder 1 of the piston 2 can be sensed by a conventional pulse counter, not illustrated here, e.g. including a belt running over return pulleys at either end of the cylinder and attached by one part to the dog. The pulse counter thus sends signals when a pre-determined stop position for the piston has been arrived at. By fluid counter-pressure in the cylinder, the piston is caused to stop simultaneously, as the braking device in accordance with the invention is instantly activated for locking the piston in the stop position.

Figure 3:
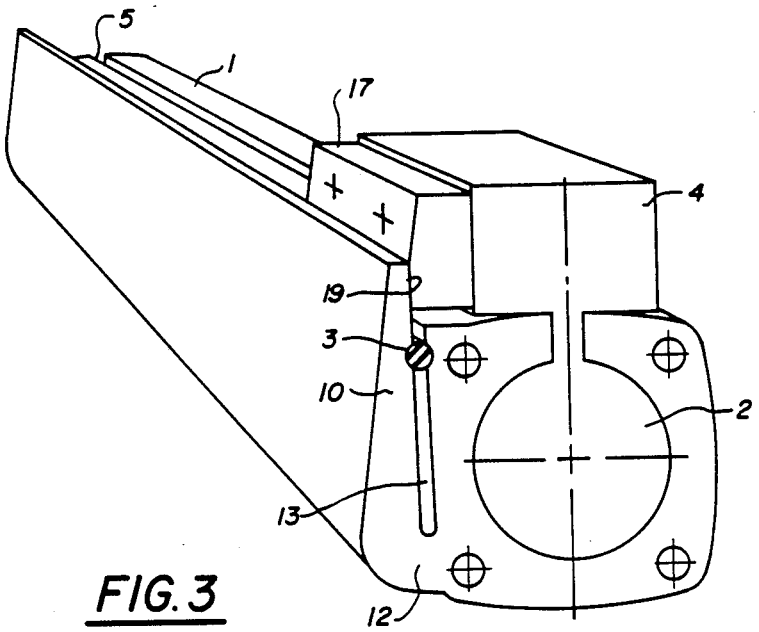
Figure 5:
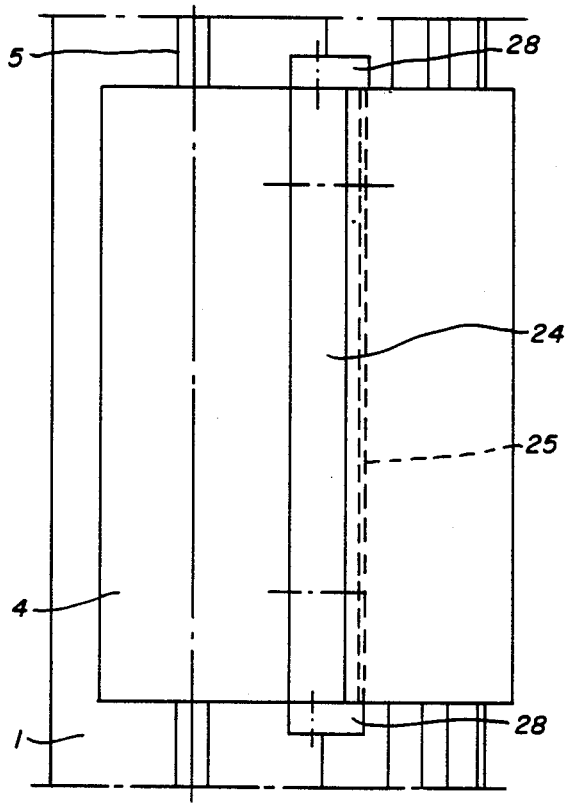
FIG. 5 is a partial view seen from above of the arrangement illustrated in FIG. 4.

FIG. 3 illustrates a second embodiment of the invention, in which the space 13 is formed directly in the cylinder material. In this embodiment the movable leg 10 has a braking surface 19 at its upper inner edge. The space is sealed in this embodiment with the aid of an O-section sealing member 3, situated in arcuate, longitudinal circular grooves, one in the cylinder wall and one in the leg. A braking device 17′ is attached to the dog 4, and this device has a braking surface intended for engagement against the braking surface 19. As described in connection with FIG. 2, the space 13 is connected to a pressurized fluid source and can thus be put under pressure. The function of the arrangement illustrated in FIG. 3 corresponds to the function of the arrangement illustrated in FIG. 2, with the difference that only one braking surface is used here for carrying out the braking function, the braking device 17′ and the dog taking support from the cylinder wall itself when acted on by the braking surface 19.

Figure 4:
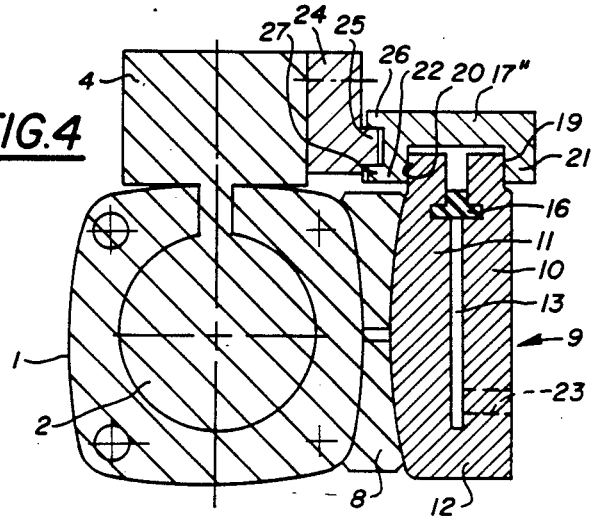

FIG. 4 illustrates a third embodiment of the invention, in principle corresponding to the one in FIG. 2 with the difference that the braking device 17″ of the dog 4 is formed as a yoke or caliper with two flanges 21 and 22, each extending on the outside of of the section 9, which is fastened to the cylinder 1 via the adapter member 8. The leg ends of the bar thus have braking surfaces 19, 20 on their sides facing away from each other. The function here will be that when pressure is supplied to the space 13 via a connection (indicated at 23), the braking surfaces 19 and 20 of the legs will engage against the braking surfaces of the braking device 17″. It is also shown in the Figure how the braking device can be attached to the dog 4 in a way such that it is given a certain amount of movement in a plane at right angles to the centre axis of the cylinder. The braking device will be floating and can adjust to small dimension variations along the bar 9. This is achieved by an attachment means 24 mounted on the dog 4 being provided with a longitudinal projection 25 on either side of which two flanges 26 and 27 on the caliper 17″ engage with a sliding fit. The caliper 17″ is prevented from moving axially in relation to the attachment means 24 (see FIG. 5) with the aid of a stop plate 28 fastened to each end of the attachment means.

Figure 6:
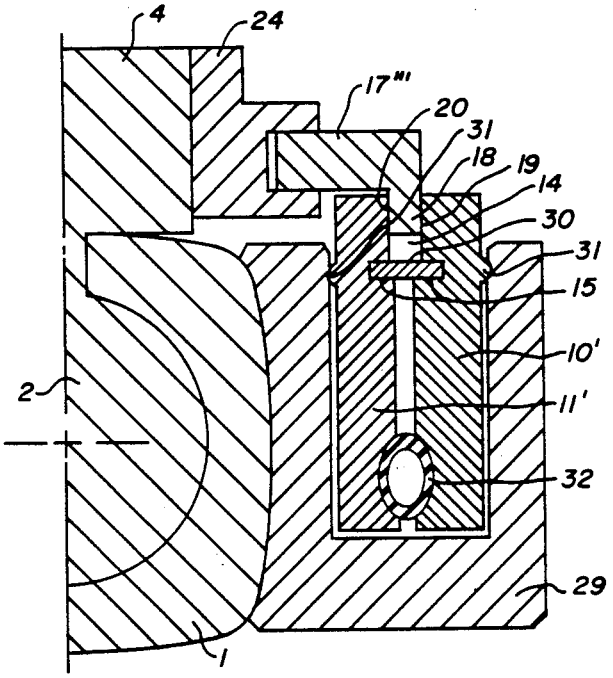
FIG. 6 is a schematic section of a fourth embodiment of the invention.

The fourth embodiment is schematically illustrated in FIG. 6. In this embodiment the bar section has been replaced by two bars 10′ and 11′, taking the place of the legs and which are not intrinsically joined to each other. The two bars 10′, 11′ which as with the previously described bar section 9 extend along the length of the cylinder 1, are carried in a U-shaped rail 29. The previously described longitudinal seal can be replaced in this case by such as a steel strip 30 accommodated in grooves 15 of the bars. At the same height as the strip 30 the respective bar 10′ and 11′ is provided with a longitudinal bead or the like 31, resting in a corresponding groove on the inside of the respective leg of the rail 29. A tube 32 is arranged downwardly between the bars and is suitably situated in longitudinal recesses on the inside of the bars, as will be seen from the Figure. The tube is connected to a pressurized fluid source. In the same way as described in connection with FIG. 2, the bars 10′ and 11′ upwardly form a gap 14 into which a flange portion 18 of a braking means 17‴ extends. In a corresponding way as described in connection with FIG. 4, the braking device 17‴ is displaceable in relation to the attachment means 24 in a plane at right angles to the central axis of the cylinder 1. An axial displacement of the braking device 17‴ in relation to the attachment means 24 is similarly prevented with the aid of such as stop plates 28, as previously described. When pressurized fluid is supplied to the tube 32, the ends of the bars are urged outwards, causing the upper ends with their braking surfaces 19 and 20 to clamp around the flange portion of the braking device 17‴, to brake and fixedly retain the piston in a given position.

By way of summary can be said that, as will have become understood from the description hereinbefore, the invention is very simple in its implementation, simultaneously as a reliable and operationally secure function is achieved. The braking device can either be formed so that it brakes and restrains the piston when pressure is unloaded from the braking device or when pressure is applied to the braking device. As described in connection with the function of the braking device, its parts will have minimum wear, since the piston should suitably have stopped in its stop position when the braking device is activated. Of course, precisely this sequence is not necessary for the function of the invention.

As previously mentioned, the invention has been illustrated very schematically on the drawing and it should be understood that the details of the invention can vary within the scope of the knowledge possessed by one skilled in the art.

Accordingly, the leg 10 can be screwed to the leg 11, or the cylinder 1 or connected thereto with such as a steel leaf spring. The adapter member 8 illustrated in FIG. 2 can be implemented such as only to join the lower part of the bar section 9 to the cylinder, whereby the leg 11 will be movable in relation to the cylinder. It should be further understood that in the arrangement illustrated in FIG. 6, it is possible only to use one leg, acting with the tube against a fixed surface on the cylinder.

Although arrangements operating with compressible media such as compressed air have been solely dealt with here, one skilled in the art will understand that the invention is also applicable to piston-cylinder arrangements operating with incompressible media, such as hydraulic oil. In this case the braking device can be used as a safety or emergency brake should hydraulic pressure collapse. As indicated in the introduction, the invention is of course equally as usable in other connections where linear movements are present, e.g. in linear motors, ribbon or belt cylinders and in cylinders with magnetic pistons and an exterior rider not mechanically attached to the piston.

Both gas (air) and liquid can be used as the operating fluid for the braking device in accordance with the invention. The braking device can also be conceived as being operated with the aid of electromagnets.

I claim:

1. A braking arrangement for a rodless piston, comprising:

housing means defining a cylinder having a longitudinally elongated, enclosed chamber receiving a rodless piston which is longitudinally shorter than said chamber and capable of being moved longitudinally of the cylinder in the chamber throughout a stroke in a stroke direction;

fluid pressure means selectively communicating with said chamber for moving said piston longitudinally of the cylinder in said stroke direction;

dog means effectively connecting with said rodless piston for movement therewith along said stroke, said dog means having a portion which is physically accessible from externally of said cylinder;

at least one first braking surface provided on said housing means and having a length longitudinally of said housing means which is at least as long as the maximum length of said stroke;

at least one second braking surface provided on said portion of said dog means so as to be engageable with said at least one first braking surface throughout the length of said stroke; and means operable for moving at least one of said first and second braking surfaces towards and away from one another, generally transversally of said cylinder, into and out of braking engagement with one another, respectively for stopping said rodless piston at an intended position along said stroke, and freeing said rodless piston to be moved along said stroke in said stroke direction.

2. The braking arrangement of claim 1, wherein:

said housing includes a fixed portion, a leg which is pivotally movable with respect to said fixed portion about an axis which is parallel to said stroke direction, and means supporting said leg on said fixed portion;

at least one said first braking surface being provided on said leg; and said means operable for moving at least one of said first and second braking surfaces towards and away from one another comprising means for pivotally moving said leg about said axis.

3. The braking arrangement of claim 2, wherein:

said means operable for moving said at least one of said first and second braking surfaces towards and away from one another comprises means defining a pressurize-to-expand, depressurize-to-contract expansible-contractible enclosed space between said fixed portion and said leg, so that said enclosed space can be selectively joined to a fluid medium for pressurizing and depressurizing said enclosed space for pivotally moving said leg about said axis.

4. The braking arrangement of claim 3, wherein:

said fixed portion comprises a rail which is generally U-shaped in transverse cross-sectional shape;

said housing further includes a second leg which is pivotally movable with respect to said first portion about an axis which is parallel to said stroke direction;

means supporting said second leg on said fixed portion;

another said first braking surface being provided on said second leg;

said leg and said second leg being disposed within said U-shaped rail with said one and other first braking surfaces facing towards and spacedly confronting one another;

another said second braking surface is provided on said portion of said dog means;

said one and other second braking surfaces are disposed between and are respectively confronted by said one and other first braking surfaces and are arranged to be respectively engaged by said one and other first braking surfaces upon pressurization of said enclosed space.

5. The braking arrangement of claim 4, wherein:

said leg and said second leg each have laterally opposite edges, said means supporting said leg and said second leg on said fixed portion comprises respective cooperating bead and groove fulcrums pivotally hinging said leg and said second leg within said U-shaped rail at respective sites which are disposed intermediate said edges of said leg and said second leg;

said one and other first braking surfaces being provided between respective said sites and corresponding one respective said edges on said leg and said second leg; and said means defining said pressurize-to-expand, depressurize-to-contract expansible-contractible enclosed space comprising a tube engaged between said leg and said second leg between respective said sites and corresponding other respective said edges on said leg and said other leg.

6. The braking arrangement of claim 3, wherein:

said means supporting said leg on said fixed portion comprising a web integrally connecting respective parts of said fixed portion and said leg and permitting flexure of said leg with respect to said fixed portion for providing pivotal movement of said leg about said axis.

7. The braking arrangement of claim 6, wherein:

another said first braking surface is provided on said fixed portion of said housing;

said one and other first braking surfaces face towards and spacedly confront one another;

another said second braking surface is provided on said portion of said dog means;

said one and other second braking surfaces are disposed between and are respectively confronted by said one and other first braking surfaces and are arranged to be respectively engaged by said one and other first braking surfaces upon depressurization of said enclosed space.

8. The braking arrangement of claim 6, wherein:

another said first braking surface is provided on said fixed portion of said housing;

said one and other first braking surfaces face away from one another;

another said second braking surface is provided on said portion of said dog means;

said one and other second braking surfaces face towards one another and spacedly confront one another;

said one and other first braking surfaces are disposed between and are respectively confronted by said one and other second braking surfaces and are arranged to be respectively engaged by said one and other second braking surfaces upon pressurization of said enclosed space.

* * * * *